United States Patent [19]

Arbeloa

[11] Patent Number: 4,667,932

[45] Date of Patent: May 26, 1987

[54] ELECTROHYDRAULIC JACK

[76] Inventor: Jesus I. Arbeloa, Aoiz, 16, Pamplona, Spain

[21] Appl. No.: 808,676

[22] Filed: Dec. 16, 1985

Related U.S. Application Data

[63] Continuation of Ser. No. 471,018, Mar. 1, 1983, abandoned.

[30] Foreign Application Priority Data

Mar. 2, 1982 [ES] Spain ..... 263602
Feb. 16, 1983 [ES] Spain ..... 270376

[51] Int. Cl.[4] ..... B66F 3/24
[52] U.S. Cl. ..... 254/93 A
[58] Field of Search ..... 254/93 A, 93 H, 93 R; 417/410, 411; 60/452, 487; 92/79, 107

[56] References Cited

U.S. PATENT DOCUMENTS 1,546,997 7/1925 Reschke ..... 417/410
2,333,530 11/1943 Ernst ..... 60/452
2,485,240 10/1949 Jackson ..... 60/487
3,022,901 2/1962 Fisher ..... 92/79

FOREIGN PATENT DOCUMENTS 932157 8/1955 Fed. Rep. of Germany ... 254/93 A

*Primary Examiner*—Frederick R. Schmidt
*Assistant Examiner*—Judy J. Hartman
*Attorney, Agent, or Firm*—Kuhn and Muller

[57] ABSTRACT

An improved electrohydraulic jack is disclosed which includes an electromotor for driving a gear pump to transfer an oil supply between a pressure chamber and a supply chamber for elevating a lifting element of the jack.

14 Claims, 7 Drawing Figures

A-B-C-D

ELECTROHYDRAULIC JACK

This application is a continuation of application Ser. No. 471,018, filed Mar. 1, 1983 abandoned.

BACKGROUND OF THE INVENTION

The present invention relates to an electrohydraulic jack.

The device in which the invention is embodied is intended to constitute an element by heavy loads can be raised, and kept at a given level after the relevant hoisting operation.

Although it can be used for hoisting any type of load, the inventive jack has been specially designed to be applied to the automotive field, replacing conventional hydraulic or mechanical jacks for lifting vehicles.

SUMMARY OF THE INVENTION

The main object of the invention is to eliminate the manual drive which is necessary in conventional jacks, whether hydraulic or mechanical, using in the present case, the actual battery of the vehicle as the drive source. In this sense, the jack which the invention proposes is provided with a hydraulic circuit for raising and lowering the respective piston, a hydraulic circuit in which a gear pump is inserted, which is driven by a motor, preferably by direct current and with a working voltage equivalent to that of the vehicle's battery, i.e. 12 volts.

Another aim of the invention relates achieving a compact device with high operative capacity, which has been provided by the double drive piston, so that it is telescopically extensible, which means that for a given hoisting magnitude, the height of the unit is considerably decreased, when this piston is withdrawn into an inoperative position.

Yet another object of the invention is to simplify, to the maximum, the integral/elements of the device which could give rise to failure; in this connection, it has been foreseen that the hydraulic circuit has no unidirectional valves in the different ductings of the circuit, in order to retain the fluid in the pressure chamber or to allow it to return to the supply chamber.

Other advantages derived from the inherent organization of the electrohydraulic jack which the invention proposes, will become evident from the description to be made hereinbelow.

For this, the jack is made up of a platform or supporting chassis, on which the pressure cylinder and the drive motor are installed, the latter assisting the respective gear pump.

Although the oil supplying device or chamber can be located anywhere in the platform, it has been foreseen that to reduce the volumetric space to the maximum, this chamber be installed perimetrically with respect to the actual pressure chamber, setting up the relevant ductings between both chambers and the gear pump, through the actual support platform.

As mentioned above, the pressure chamber is double, so that inside the main piston, a second chamber is formed, and in this, a secondary piston works, both chambers communicating through a hole and having different sized pressure surfaces, so that the oil pressure first causes the displacement of the main piston, and the secondary piston does not start to move until the former has reached its maximum extension.

Alongside the secondary piston, an axial hole has been provided, blind inside and open to the outside, threaded, in which a threaded shank is coupled, provided with the respective support head for the object to be raised, so that through that shank it is possible to regulate in height the minimum level for the jack and consequently also the maximum level reached in its total extension.

Obviously the ducting between the gear pump and the pressure chambers can be assisted by a valve which closes that duct once hoisting has been completed, preventing the fluid process and, consequently, maintaining that hoisting situation, while a second valve in a return duct which connects the pressure chamber with the supply chamber, allows the fluid to return, for the lowering of the jack, but in order to eliminate these valves, it has been foreseen that the lowering of the jack takes place through the gear pump itself, by turning the electromotor in the opposite direction, and that keeping the jack in an operative position is done either through short-circuiting the motor poles, thus causing resistance to its turning, which provokes the blocking of the gear valve pinions, preventing them turning, which is necessary for the fluid to return to the supply chamber. Another possibility of keeping the jack in an operative position, lies in arranging a pressurestat in the ducting arranged between the gear pump and the pressure chanmber or cylinder. The pressurestat interrupts the electric feed circuit of the motor, when the pressure in the main chamber exceeds a preset level and which, when that pressure disappears through the return of the fluid through the gear pump, leads to the said motor starting to work again.

BRIEF DESCRIPTION OF THE DRAWINGS

To complete the description to be made immediately and to understand the characteristics of the invention better, a set of drawings is attached to the present specifications, as an integral part thereof, in which the following has been represented, in an illustrative and unlimiting manner.

DETAILED DESCRIPTION

Figure 1:
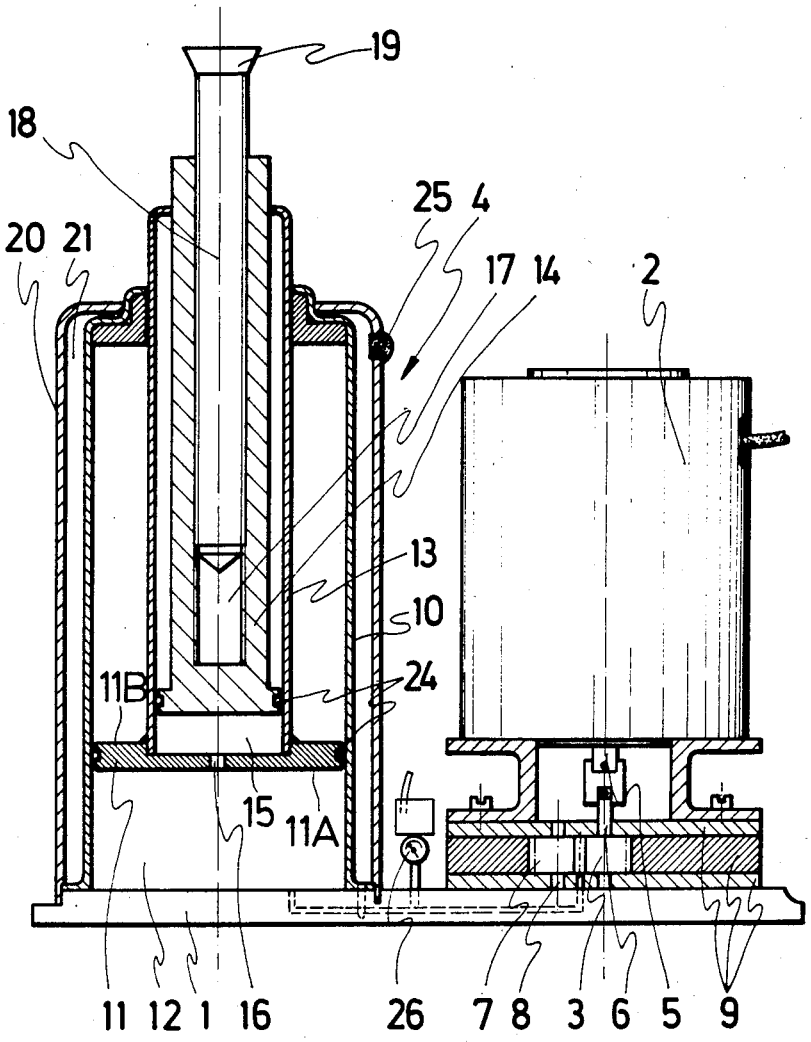
FIG. 1 shows a side elevation and cross-section view of the electrohydraulic jack which comprises the object of the present invention.
Figure 2:
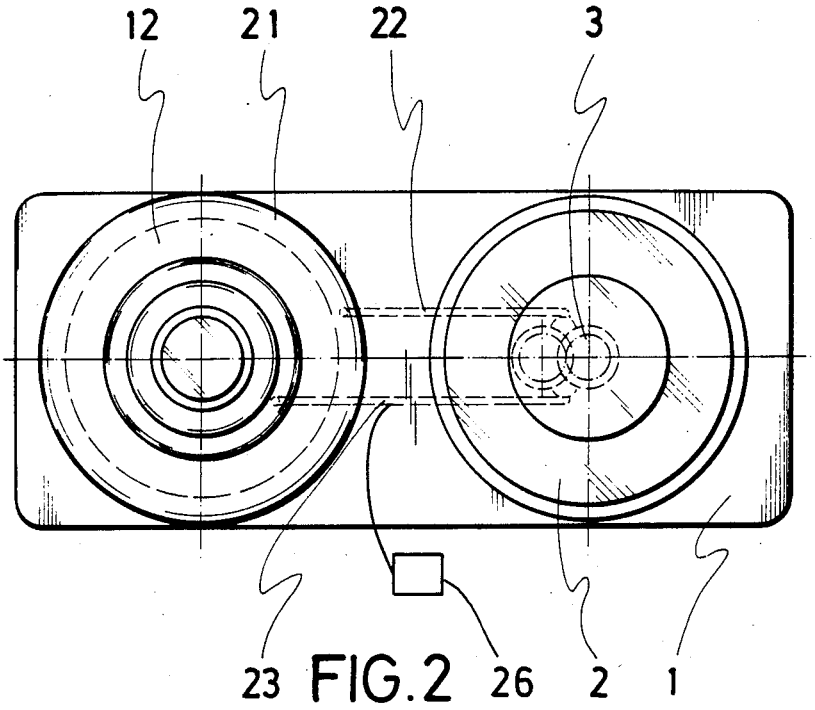
FIG. 2 shows a schematic representation, plan view, of that jack, in which we can clearly see the communication between the oil supply chamber and the pressure chamber, through the gear pump.
Figure 3:
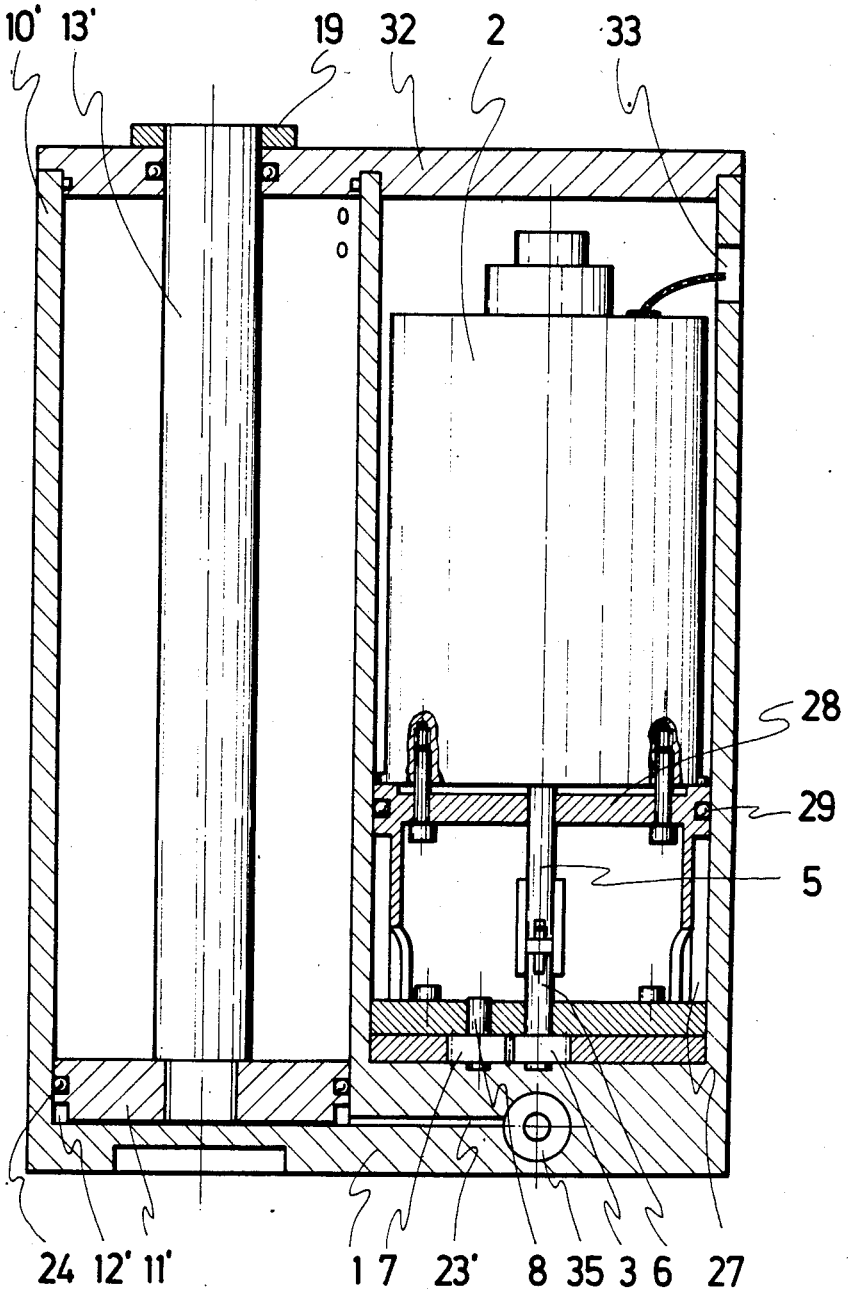
FIG. 3 shows a similar illustration to FIG. 1, according to an embodiment in which the piston is single and the chamber corresponding to it, together with the oil suppliers and that for housing the motor, are defined in a single-part block which acts simultaneously as the chassis of the assembly.

As shown in the figures, and more specifically, of FIGS. 1 and 2, the electrohydraulic jack of the invention comprises a base platform 1. An electric drive motor 2 for a respective gear pump 3 and a hoisting assembly 4 are independently installed on the base platform 1.

The motor 2, due to the preferential application of the jack to vehicles, will be direct current and with a working voltage of 12 volts, in order to enable a vehicle's battery to be used as a source of power.

The axle 5 of the motor 2, through the suitable transmission is joined to the shaft 6 of one of the pump gears, specifically of the one corresponding to reference numeral 3, which, in turn, meshes with the complementary pinion 7, whose shaft 8 is installed parallel to shaft 6, on the block 9 which supports the assembly and which forms the sealed housing for the pump pinions.

Regarding the hoisting assembly 4, a cylindrical body 10 in conjunction with a main piston 11, forms a main pressure chamber 12 defined by the cylinder 10 and the lower facing surface 11A of said piston 11. Acting as an elevator element, this piston stretches axially from its upper facing surface 11B into a cylindrical body 13, which with the aid of a secondary piston 14, defines a secondary chamber 15 communicating with the main chamber 12 through an axial hole 16. In turn, the secondary piston 14 is provided with a drill 17, blind inside and open at its top end, and threaded, in which a threaded shank 18 fits, finished in the respective head 19 which touches the object to be lifted.

Surrounding the cylindrical body 10, there is a second cylindrical body 20, which forms a chamber 21, with the previous one, for the oil supply.

A duct 22 connects the oil supply chamber 21 with the gear pump 3 and another duct 23 connects that gear pump 3 with the main pressure chamber of cylinder 12, as we can see in detail in FIG. 2.

In accordance with this arrangement and from a bottom limit situation for the hoisting assembly 4, the starting of the motor 2 leads to the turning of the gear pump, transferring the fluid in the supply chamber 21 to the main pressure chamber 12, making the main piston 11 move, which keeps the inside of the chamber perfectly sealed, thanks to a gasket 24. When this main piston 11 reaches its top limit position, the oil starts to flow towards the secondary pressure chamber 15 through the hole 16, making the secondary piston 14 shift, with the consequent dragging of the threaded shank 18.

Obviously, this threaded shank 18 must have been suitably regulated in advance, by turning it.

To ensure that the mass of air corresponding to the volume of oil absorbed or returned by the gear pump 3, can enter and be removed from the oil supply chamber 21, this chamber 21 has been provided with a stopper 25, preferably made of porous sintered bronze, which allows the free flow of air through it, but not of oil.

The ducting 22, 23 which establish communications between the oil supply chamber 21, the gear pump 3 and the main pressure chamber 12, are preferably arranged within the actual platform 1 which supports the assembly.

The pressure surface of the main piston is considerably larger than that of the secondary piston, so that in practice, the shifting of the main piston 11 takes priority over that of the secondary piston 14 which only shifts when the former reaches its top limit position.

On the other hand, and so that the oil supply chamber has sufficient capacity to feed the main and secondary chambers, in the situation of maximum extension for the jack, it has been designed that the following is always fulfilled:

$S_3 = 1.3 + 1.5\,(S_1 + S_2)$, in which $S_1$ is the cross-section of the secondary pressure chamber, $S_2$ is the cross-section of the primary pressure chamber and $S_3$ is the cross-section of the oil supply chamber.

As mentioned above, for the jack to lower, it has been foreseen that the electromotor 2 turns in the opposite direction (reversible motor), which means that the gear pump 3 also turns in the opposite direction, inverting the sense of its operativity and transferring the oil from pressure chambers 12 and 15 to the supply chamber 21.

Alongside this, to keep the jack in the operating position, there are two possibilities: one to short-circuit the motor poles i.e. its inductor coil, by any well known method, after reaching the working position, whereby its coiling causes the motor and thus the gear pump to brake, as in a conventional motor brake system. Another solution, which is independent and complementary to the previous solution, consists of placing a pressurestat 26 on the supply ducting 23 of the pressure chambers, which controls by any one of a number of electronic or electromechanical systems known in the art the electric circuit and the power supply of the motor 2, so that when the pressure chambers reach a preset level, this makes the motor stop, whereas when pressure is being lost in main pressure chamber 12 as the result of the oil returning or leaking back through duct 23, the gear pump 3 and duct 22 into chamber 21, the motor starts working again, to recover the original and preset limit pressure.

In the first case, in that of short-circuiting the motor poles, special adjustment is required in the pump, establishing a very fine contact between the steel pinions and the chamber containing them; this chamber should be made of a slightly deformable material, and this chamber is slightly deformed by the pinions while the motor rotates.

Figure 4:
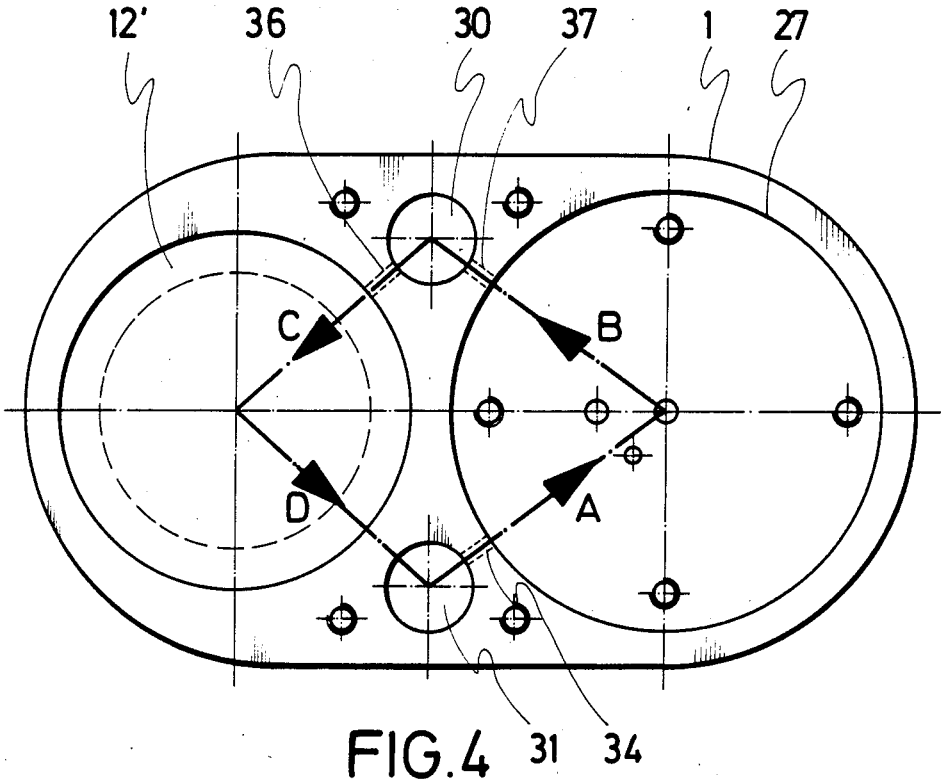
FIG. 4 shows a schematic plan view of the assembly shown in the previous figure.
Figure 5:
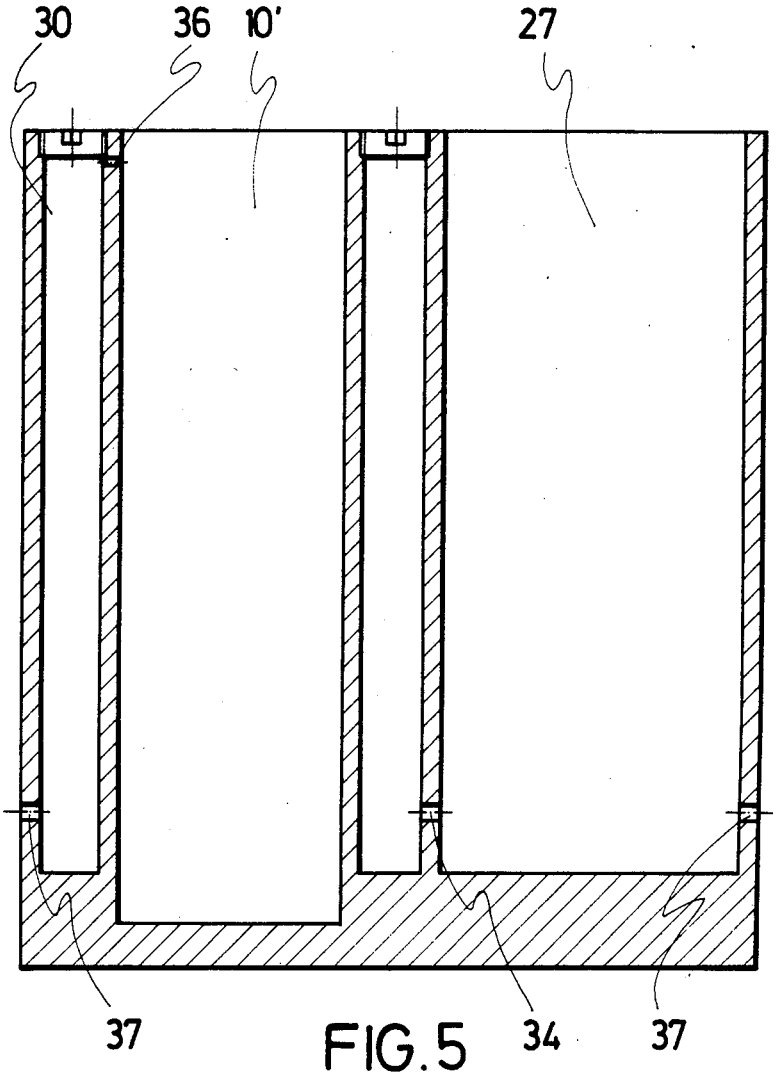
FIG. 5 shows a cross-section of the collector, according to the cutting line A-B-C-D of FIG. 4.

According to the alternate embodiment illustrated in FIGS. 3 to 7, the base platform 1 extends at the top, like a single part, into a prismatic body in which the pressure chamber 12', and a housing 27 for the gearing pump 37 are defined, which in turn acts as an oil supply chamber, inside which housing, the motor 2 is also placed, made independent of the chamber 27 by a plate 28 provided with the respective sealin gasket 29. Furthermore, inside this prismatic block, two other cavities 30 and 31 are defined, coaxial with the previous ones, as can be seen in FIG. 4, and complementary to chamber 27 in their oil supplying function. In this case, there is only one main piston 11' and the electromotor 2 is only operative in the shifting of that piston for it to rise. The block closes at the top through a cover 32, through which the shank of the piston 11' emerges, also finished in a support head 19. There is a side hole 33 in the block for access of the electromotor supply cables.

To be more precise, the oil is supplied from the chamber 31, through a hole 34 to the chamber 27, and through the gear pump 3, 7; when the latter operates, oil is sent to the pressure chamber 12' through ducting 23' and with a single-direction valve placed therebetween, which can be set up in the collector 35. The upward limit situation for the shank 13' is determined by the existence of a ducting 36 in the top end part of the chamber formed by the cylindrical housing 10', a ducting which becomes operative when it is exceeded by the piston 11' and which makes communication for the oil towards the complementary chamber 30, from which it also returns to the chamber 27 through the hole or ducting 37 made on a lower level.

Figure 6:
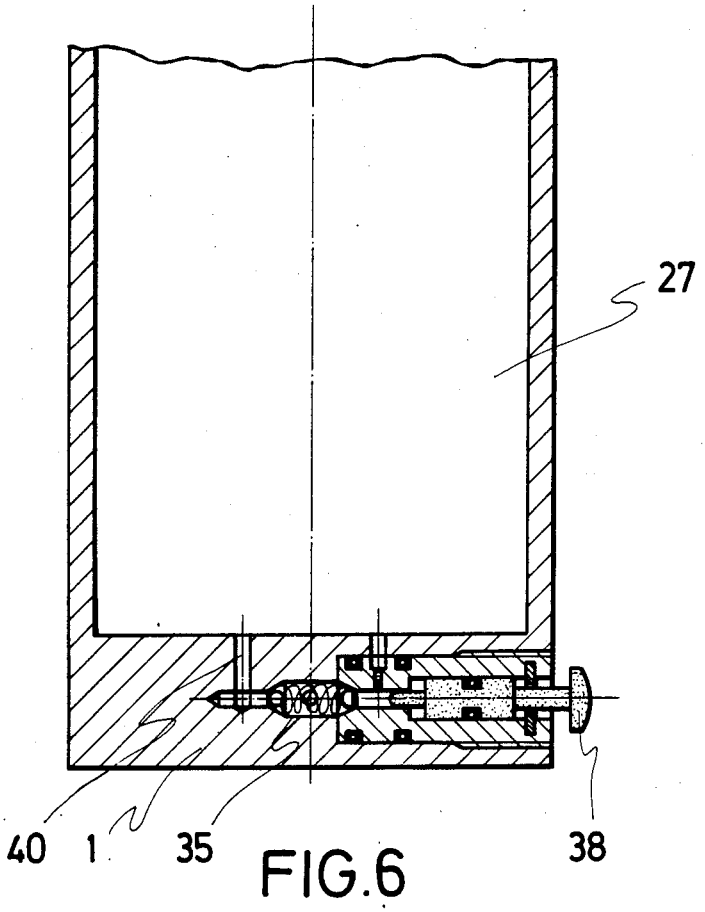
FIG. 6 shows a cross-section detail of the return valve used for the lowering of the piston.
Figure 7:
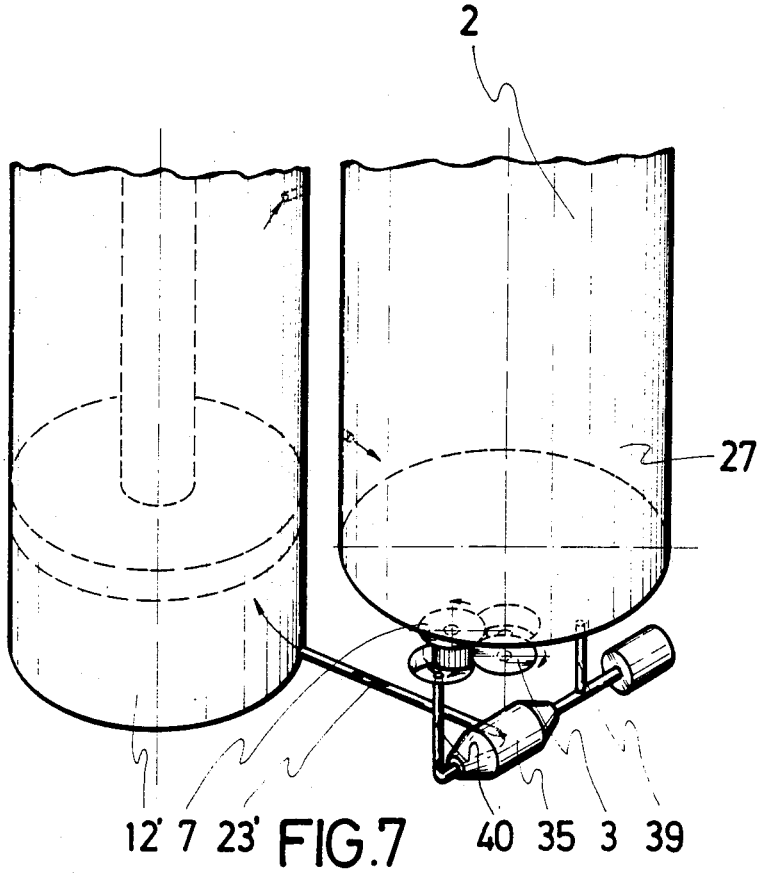
FIG. 7 shows finally a schematic perspective detail view of the assembly corresponding to the embodiment variation illustrated in FIGS. 3 to 6.

When it is wished to lower the shank 13', a hand-operated non-return valve 38 is opened, and which is shown in detail in FIG. 6; this communicates the collector 35 and the return duct 39 to the chamber 27, as can be seen in FIG. 7.

Thus, at the expense of the oil contained in the actual chamber 27 and in the auxiliary chambers 30 and 31, when the gear pump 3, 7 starts the work, the oil passes through the ducting 40, towards the collector 35 and from here, through ducting 23 to the pressure chamber 12', making the piston 11' move. When it is wished to make the piston move in the other direction, i.e. its return to the bottom position, just work valve 38 by hand, so that the communication between the chamber 12' and chamber 27 is made, through duct 23', the collector 35 and the duct 39, which means that the oil returns through the supply chambers and the piston drops due to its own weight which it is supporting.

I claim:

1. An electrohydraulic jack comprising: a vertically elongated main cylinder; a main piston having an upper and a lower facing surface mounted in the cylinder for axial reciprocation whereby a main pressure chamber is formed in said cylinder by the lower facing surface of said piston; an elevator element vertically mounted and axially extending within said main cylinder comprising a cylindrical body having a first end fixedly connected to the upper facing surface of the main piston and a second opposite end external of the main cylinder which is open, a secondary piston slidably mounted in the cylindrical body so as to define a secondary pressure chamber bonded by the upper facing surface of the main piston, the secondary piston and the cylindrical body, the main piston having a hole extended therethrough so as to establish fluid communication between the main pressure chamber and the secondary pressure chamber; means for containing a supply of oil for hydraulic operation of said jack; fluid communication means between the containing means and the main pressure chamber within the cylinder to establish a hydraulic drive circuit; a gear pump within the hydraulic drive circuit for transferring oil between the containing means and the main pressure chamber in the cylinder via the fluid communication means, wherein the fluid communication means form a passage from the gear pump to the main pressure chamber to permit flow of oil from the gear pump to the main pressure chamber for translating the main piston to a maximum axial extent before axial displacement of the second piston, the gear pump including a first pinion and a second pinion idly connected to the first pinion; an electromotor having a drive shaft directly coupled to the first pinion for driving the gear pump and means for selectively lowering said elevator element from on operative position.

2. An electrohydraulic jack, as set forth in claim 1, wherein the oil containing means comprises a second cylinder concentric with and disposed outside of and spaced from the main cylinder to define an oil supply chamber therebetween.

3. An electrohydraulic jack, as set forth in claim 1, wherein the main piston pressure surface adjacent the main pressure chamber is larger than the secondary piston pressure surface adjacent the secondary pressure chamber, and wherein said electromotor is adapted to be operated by a vehicle battery as a source of electric power.

4. An electrohydraulic jack, as set forth in claim 3, wherein the elevator element further comprises a piston rod fixedly connected to the secondary piston and extended through and external of the cylindrical body, wherein the piston rod is formed with an axial drill bore open at one end external of the cylindrical body and closed at the opposite end, and a shank mounted in said drill hole and threadably coupled to said piston rod, shank having a head at one end for supporting an object to be lifted.

5. An electrohydraulic jack, as set forth in claim 4, wherein said electromotor is operative to drive said gear pump in opposite rotary directions to thereby raise or lower the elevator element.

6. An electrohydraulic jack, as set forth in claim 5, wherein said electromotor includes motor poles and further comprising means for short-circuiting the motor-poles in order to ensure a force tending towards braking the motor, and further comprising a pump housing for tightly housing the pinions, the pump housing being made of slightly deformable material with respect to turning the pinions by the motor.

7. An electrohydraulic jack, as set forth in claim 5, further comprising a support platform, the main cylinder and the electromotor being mounted on the support platform, and at least part of the fluid communication means being integrally formed within the support platform.

8. An electrohydraulic jack, as set forth in claim 5, wherein the fluid communication includes a ducting connected between the gear pump and the lower chamber, and a pressurestat operatively connected to the ducting to sense pressure and operatively connected to the electromotor so as to deactivate the electromotor when the pressure in the ducting exceeds a preset level and activate the electromotor when the pressure in the ducting falls below a preset level.

9. An electrohydraulic jack, as set forth in claim 5, further comprising a stopper of porous sintered bronze connected to the containing means for freely passing air to and from the containing means, the stopper being impervious to the passage of oil.

10. An electrohydraulic jack, as set forth in claim 2, wherein said gear pump and said electromotor provide the means for keeping the jack in an operative position.

11. An electrohydraulic jack, as set forth in claim 2, wherein said electromotor is adapted to be operated by a vehicles battery as a source of electric power.

12. An electrohydraulic jack, as set forth in claim 1, which includes a housing with a chamber for enclosing an assembly of the electromotor and the gear pump.

13. An electrohydraulic jack, as set forth in claim 12, wherein said housing comprises a second chamber for said main piston sealingly separated from the chamber enclosing the gear pump.

14. An electrohydraulic jack as set forth in claim 1 wherein said means for selectively selectively lowering said elevator element and for lowering said elevator element includes a unidirection valve mounted in the fluid communication means.

* * * * *